US011754942B2

(12) United States Patent
Omoya

(10) Patent No.: US 11,754,942 B2
(45) Date of Patent: Sep. 12, 2023

(54) IMAGE FORMING APPARATUS CAPABLE OF DETECTING ATTACHMENT STATE OF TONER CONTAINER

(71) Applicant: KYOCERA Document Solutions Inc., Osaka (JP)

(72) Inventor: Shinichi Omoya, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/862,178

(22) Filed: Jul. 11, 2022

(65) Prior Publication Data

US 2023/0015370 A1 Jan. 19, 2023

(30) Foreign Application Priority Data

Jul. 13, 2021 (JP) ..... 2021-115548

(51) Int. Cl.
*G03G 15/08* (2006.01)
*G03G 21/18* (2006.01)

(52) U.S. Cl.
CPC ..... *G03G 15/0849* (2013.01); *G03G 15/0863* (2013.01); *G03G 15/0872* (2013.01); *G03G 15/0891* (2013.01); *G03G 21/1875* (2013.01); *G03G 21/1896* (2013.01); *G03G 2215/0695* (2013.01); *G03G 2221/1892* (2013.01)

(58) Field of Classification Search
CPC ..... G03G 15/0849; G03G 15/0872; G03G 15/0891; G03G 15/0848; G03G 15/55; G03G 15/0877; G03G 2221/1892; G03G 15/0856; G03G 15/0858; G03G 15/0863; G03G 15/556; G03G 21/1875; G03G 21/1896; G03G 2215/0695
See application file for complete search history.

(56) References Cited

U.S. PATENT DOCUMENTS 5,995,772 A * 11/1999 Barry ..... G03G 15/0896 235/461
6,363,226 B1 * 3/2002 Batori ..... G03G 21/1889 399/12
2004/0095459 A1 * 5/2004 Russell ..... B41J 2/17546 347/240
2011/0188887 A1 * 8/2011 Kaneko ..... G03G 21/18 399/111
2014/0294404 A1 * 10/2014 Aratachi ..... G03G 21/1676 399/119
2017/0248904 A1 * 8/2017 Kusama ..... F16H 37/122

FOREIGN PATENT DOCUMENTS

JP 2002278249 A 9/2002

* cited by examiner

*Primary Examiner* — Arlene Heredia
*Assistant Examiner* — Laura Roth
(74) *Attorney, Agent, or Firm* — Alleman Hall Creasman & Tuttle LLP

(57) ABSTRACT

An image forming apparatus includes a motor, a container detection sensor, and a controller. When a toner container is attached, the motor generates a driving force for rotating a toner conveying member in the toner container. The container detection sensor is arranged at a position where the container detection sensor comes into contact with an outer periphery of a cam connected to the toner conveying member when the toner container is attached. The controller distinguishes between at least three attachment states of the toner container based on a sensor signal of the container detection sensor.

4 Claims, 7 Drawing Sheets

IMAGE FORMING APPARATUS CAPABLE OF DETECTING ATTACHMENT STATE OF TONER CONTAINER

INCORPORATION BY REFERENCE

This application is based upon and claims the benefit of priority from the corresponding Japanese Patent Application No. 2021-115548 filed on Jul. 13, 2021, the entire contents of which are incorporated herein by reference.

BACKGROUND

The present disclosure relates to an image forming apparatus.

An image forming apparatus detects the presence or absence of a protrusion at a specific position on a housing surface of a toner container by a microswitch, and identifies the initial toner filling amount of the toner container in accordance with the presence or absence of the protrusion detected by the microswitch. Namely, a toner container is provided with the aforementioned protrusion in accordance with the initial toner filling amount of the toner container.

SUMMARY

An image forming apparatus according to the present disclosure includes a motor, a container detection sensor, and a controller. When a toner container is attached, the motor generates a driving force for rotating a toner conveying member in the toner container. The container detection sensor is arranged at a position where the container detection sensor comes into contact with an outer periphery of a cam connected to the toner conveying member when the toner container is attached. The controller distinguishes, based on a sensor signal of the container detection sensor, between at least three states: a state where the toner container is not attached; a state where the toner container filled with toner of a first initial toner filling amount is attached; and a state where the toner container filled with toner of a second initial toner filling amount, which differs from the first initial toner filing amount, is attached. An outer peripheral shape of the cam of the toner container filled with the toner of the first initial toner filling amount differs from an outer peripheral shape of the cam of the toner container filled with the toner of the second initial toner filling amount. The container detection sensor includes a contact that can move in accordance with the contact with the outer periphery of the cam, and the contact is arranged at a position where the contact can contact the outer periphery of the cam. The container detection sensor outputs the sensor signal at a level corresponding to the position of the contact. The controller controls the motor to rotate the toner conveying member and distinguishes between the at least three states based on the level of the sensor signal during the rotation period of the toner conveying member.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

An embodiment of the present disclosure will be described below with reference to the drawings.

Figure 1:
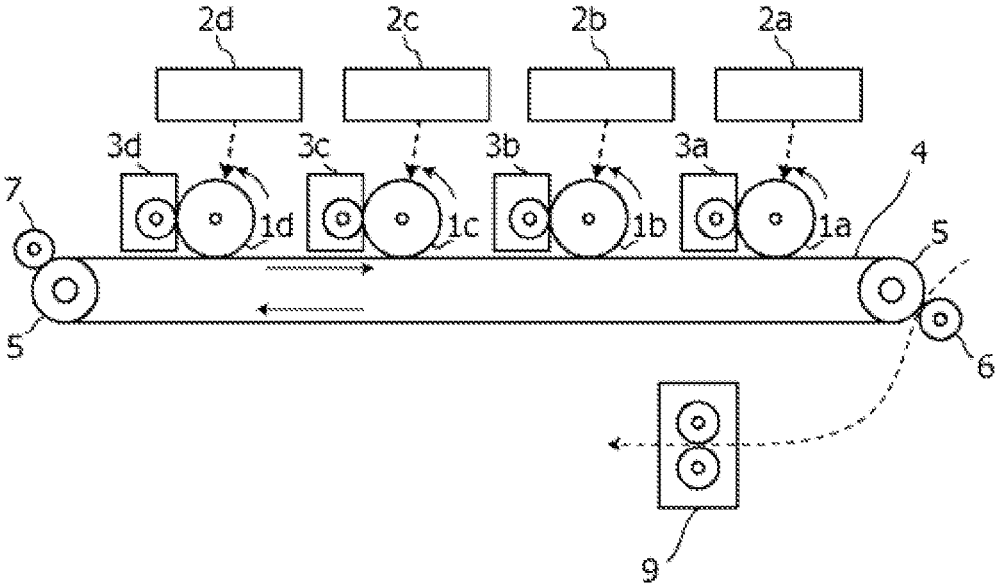
FIG. 1 is a side view showing a mechanical configuration of an image forming apparatus according to an embodiment of the present disclosure.

FIG. 1 is a side view showing a mechanical configuration of an image forming apparatus according to an embodiment of the present disclosure. The image forming apparatus shown in FIG. 1 is an apparatus having an electrophotographic printing function, such as a printer, a facsimile machine, a copier, or a multifunction peripheral.

The image forming apparatus shown in FIG. 1 includes a tandem type color image forming portion. This color image forming portion includes photoconductor drums 1*a* to 1*d*, exposure devices 2*a* to 2*d*, and developing devices 3*a* to 3*d*. The photoconductor drums 1*a* to 1*d* are photoconductors of four colors: cyan, magenta, yellow, and black.

The exposure devices 2*a* to 2*d* are devices that form electrostatic latent images on the photoconductor drums 1*a* to 1*d*. The exposure devices 2*a* to 2*d* expose the photoconductor drums 1*a* to 1*d* by irradiating the photoconductor drums 1*a* to 1*d* with laser beams corresponding images to be printed while scanning with the laser beams, thereby forming electrostatic latent images on the photoconductor drums 1*a* to 1*d*. The scanning with the laser beams is performed in a direction (main scanning direction) perpendicular to a rotational direction (sub-scanning direction) of the photoconductor drums 1*a* to 1*d*. The exposure devices 2*a* to 2*d* each include a laser scanning unit including a laser diode, which is a light source of the laser beam, and an optical element (such as a lens, a mirror, or a polygon mirror) for guiding the laser beam to the photoconductor drum 1*a* to 1*d*.

Further, a charger such as a scorotron, a cleaning device, and a static eliminator are arranged around the photoconductor drums 1*a* to 1*d*. The cleaning device removes residual toner on the photoconductor drums 1*a* to 1*d* after primary transfer. The static eliminator eliminates static from the photoconductor drums 1*a* to 1*d* after primary transfer.

The developing devices 3*a* to 3*d* are connected to a plurality of toner containers that can be attached to and detached from the image forming apparatus, which are respectively filled with toners of four colors: cyan, magenta, yellow, and black. The developing devices 3*a* to 3*d* form toner images by causing toners supplied from the toner containers adhere to the electrostatic latent images on the photoconductor drums 1*a* to 1*d*.

A magenta toner image is formed by the photoconductor drum 1*a*, the exposure device 2*a*, and the developing device 3*a*. A cyan toner image is formed by the photoconductor drum 1*b*, the exposure device 2*b*, and the developing device 3*b*. A yellow toner image is formed by the photoconductor drum 1*c*, the exposure device 2*c*, and the developing device 3*c*. A black toner image is formed by the photoconductor drum 1*d*, the exposure device 2*d*, and the developing device 3*d*.

Figure 2:
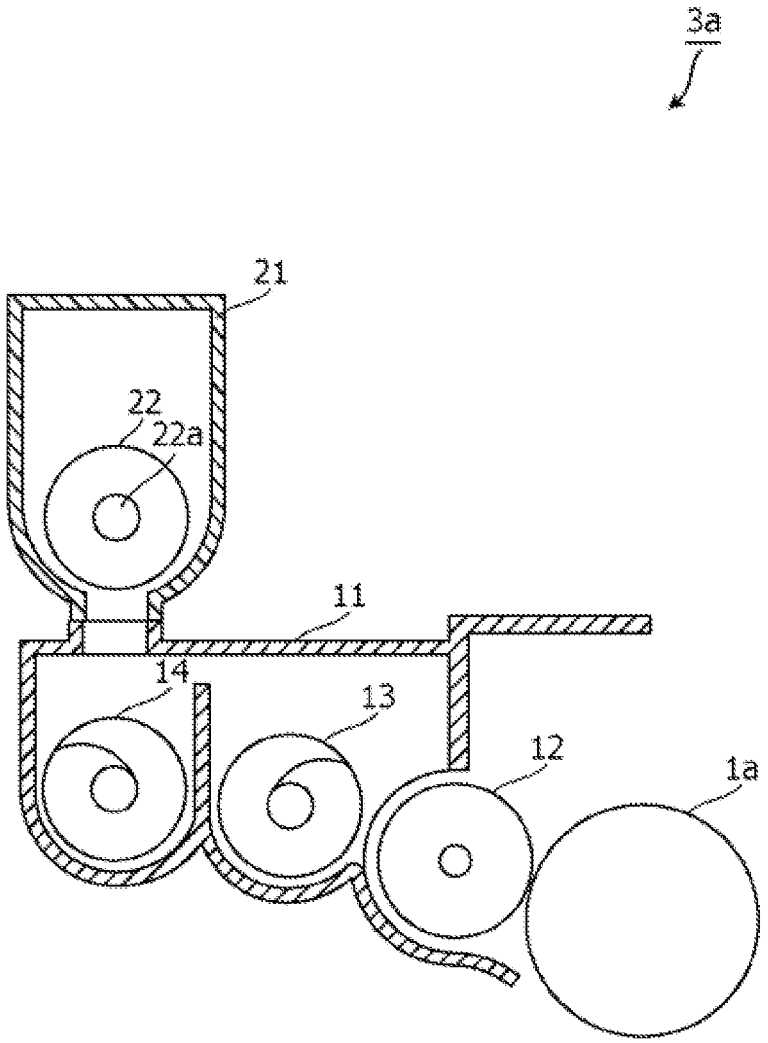
FIG. 2 is a cross-sectional view showing an example of a developing device 3*a* in FIG. 1

FIG. 2 is a cross-sectional view showing an example of the developing device 3*a* in FIG. 1. It is noted that, although FIG. 2 shows the developing device 3*a* and its surroundings, the developing devices 3*b* to 3*d* and their surroundings also have the same configuration.

As shown in FIG. 2, the developing device 3*a* includes a housing 11, a developing roller 12, and stirring screws 13 and 14. The developing device 3*a* is connected to the toner container 21. When a toner conveying roller 22 of the toner container 21 rotates, toner is supplied from the toner container 21 to the developing device 3*a*. When the amount of toner in the developing device 3*a* decreases, the toner conveying roller 22 is driven and toner is supplied to the developing device 3*a*. The toner in the developing device 3*a* is stirred by the stirring screws 13 and 14 and adheres to the developing roller 12. The developing roller 12 is arranged so as to correspond to the photoconductor drum 1*a*, and rotates at a predetermined constant speed during printing so that the toner that has adhered to the developing roller 12 adheres to the photoconductor drum 1*a*.

Referring back to FIG. 1, an intermediate transfer belt 4 is an annular image carrier (intermediate transfer body) which comes into contact with the photoconductor drums 1*a* to 1*d* and on which the toner images on the photoconductor drums 1*a* to 1*d* are primarily transferred. The intermediate transfer belt 4 is stretched over a drive roller 5 and is rotated in a direction from a contact position with the photoconductor drum 1*d* to a contact position with the photoconductor drum 1*a* by a driving force supplied from the drive roller 5.

The transfer roller 6 brings a conveyed sheet into contact with the intermediate transfer belt 4, and secondarily transfers the toner images on the intermediate transfer belt 4 to the sheet. The print sheet to which the toner images have been transferred is conveyed to a fixing device 9, and the toner images are fixed on the sheet.

A roller 7 has a cleaning brush, and brings the cleaning brush into contact with the intermediate transfer belt 4 to remove the toner remaining on the intermediate transfer belt 4 after the toner images have been transferred to the sheet.

In a conventional image forming apparatus, at least two protrusions, two microswitches, two signal lines from the two microswitches to a controller, and two I/O ports need to be provided in order to be able to detect at least three states: a state where the toner container 21 is not attached, a state where the toner container 21 filled with toner of a first initial toner filling amount is attached, and a state where the toner container 21 filled with toner of a second initial toner filling amount different from the first initial toner filling amount is attached. This increases the cost of the apparatus.

In contrast, the image forming apparatus according to the embodiment of the present disclosure can detect at least three attachment states of the toner container 21 described above at a relatively low cost as will be described below.

Figure 3:
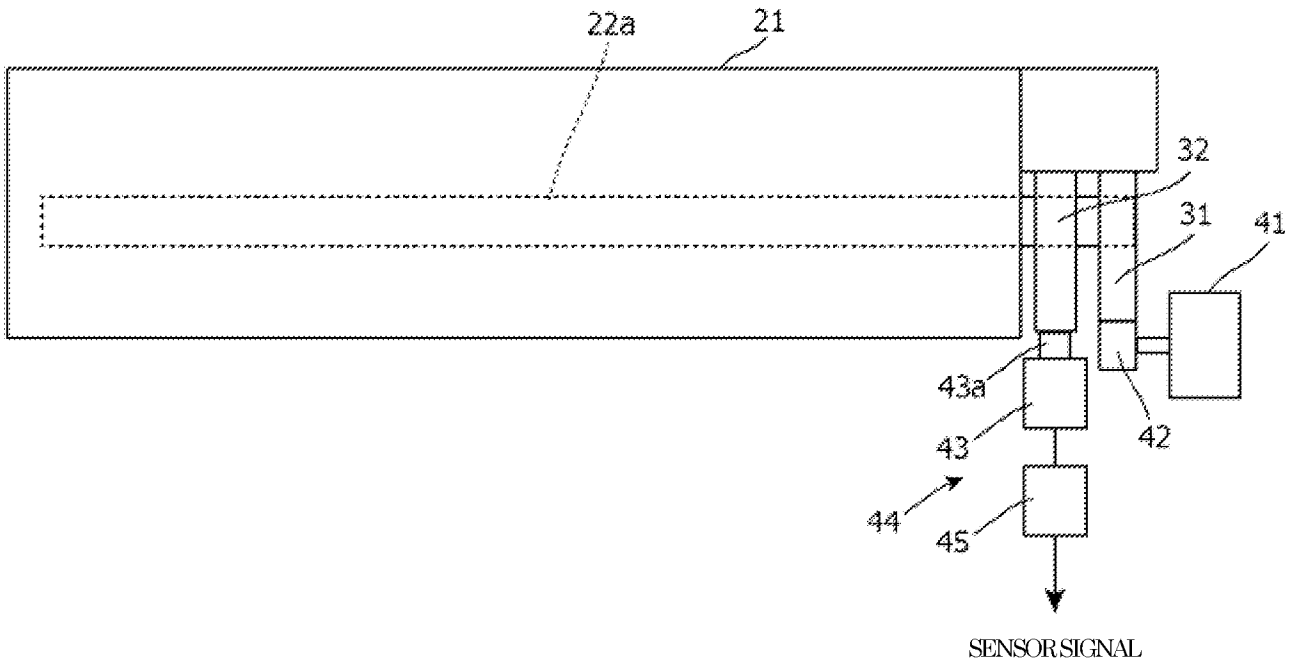
FIG. 3 is a top view showing an example of a toner container 21 attached to the image forming apparatus shown in FIG. 1.

FIG. 3 is a top view showing an example of the toner container 21 attached to the image forming apparatus shown in FIG. 1. For example, as shown in FIG. 3, the toner container 21 includes a rotation shaft 22*a* of the toner conveying roller 22, a gear 31 fixed to the rotation shaft 22*a*, and a cam 32 fixed to the rotation shaft 22*a*. On the other hand, the image forming apparatus includes a motor 41, a gear 42 connected to (a rotation shaft of) the motor 41, and a push switch 43 that can come into contact with the outer periphery of the cam 32 when the toner container 21 is attached.

When the toner container 21 is attached to the image forming apparatus, the gear 31 meshes with the gear 42, and the cam 32 comes into contact with a contact 43*a* of the push switch 43 and pushes the contact 43*a*. The contact 43*a* is arranged at a position where the contact 43*a* can come into contact with the outer periphery of the cam 32, and is a member that can move in accordance with the contact with the outer periphery of the cam 32.

When the toner container 21 is attached, the motor 41 generates a driving force for rotating the toner conveying roller 22 in the toner container 21. The driving force is transmitted to the rotation shaft 22*a* of the toner conveying roller 22 through the gears 42 and 31. The push switch 43 is part of a container detection sensor 44. The container detection sensor 44 (push switch 43) is arranged at a position where the container detection sensor 44 comes into contact with the outer periphery of the cam 32 when the toner container 21 is attached. In addition, the container detection sensor 44 includes a circuit 45 for generating a sensor signal at a level corresponding to the ON/OFF state of the push switch 43. As described above, the container detection sensor 44 outputs the sensor signal (here, a binary signal) corresponding to the position of the contact 43*a*.

Figure 4:
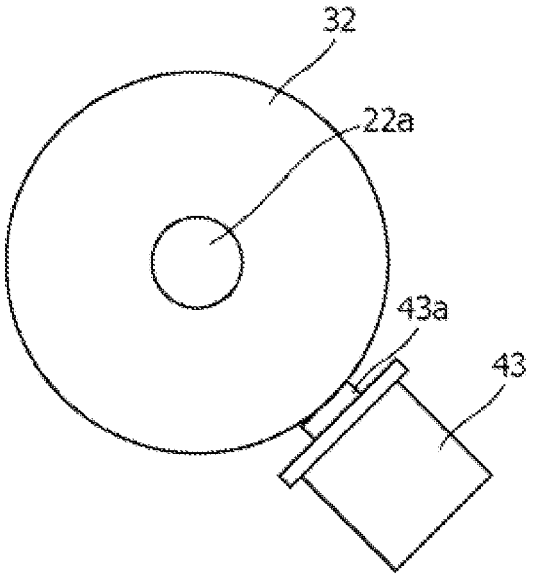
FIG. 4 shows an example of an outer peripheral shape of a cam of a bundled container.
Figure 5:
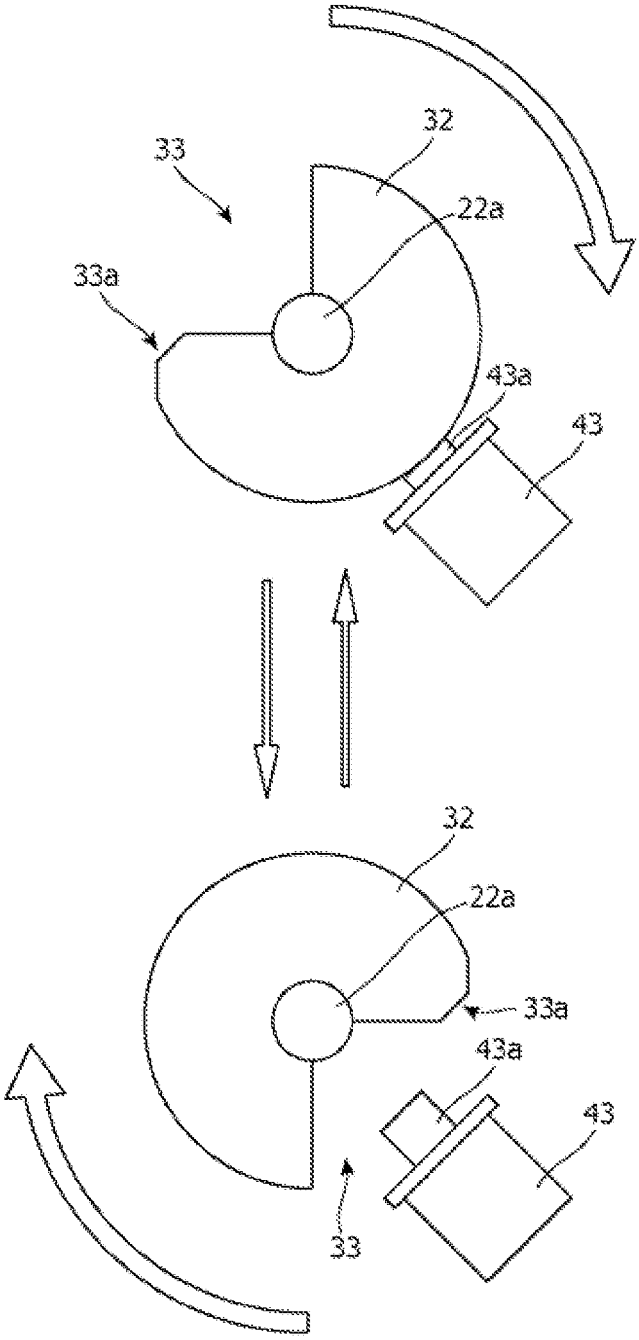
FIG. 5 shows an example of an outer peripheral shape of a cam of an optional container.

FIG. 4 shows an example of an outer peripheral shape of a cam of a bundled container. FIG. 5 shows an example of an outer peripheral shape of a cam of an optional container.

The cam 32 shown in FIG. 4 is a cam of a bundled container that is bundled with the image forming apparatus. The bundled container is filled with toner of the first initial toner filling amount. Here, the first initial toner filling amount is an amount of toner capable of printing 700 sheets at a standard printing rate.

The cam 32 shown in FIG. 5 is a cam of an optional container that is not bundled with the image forming apparatus and sold separately from the image forming apparatus. The optional container is filled with toner of the second initial toner filling amount. Here, the second initial toner filling amount is an amount of toner capable of printing 1500 sheets at the standard printing rate.

The outer peripheral shape of the cam 32 of the bundled container is different from the outer peripheral shape of the cam 32 of the optional container. Specifically, as shown in FIG. 4 and FIG. 5, the cam 32 has a disk-like shape. A notch 33 is formed in the cam 32 of the optional container. In addition, a rear end surface 33*a* of the notch 33 in the rotational direction of the cam 32 is inclined with respect to the radial direction of the cam 32 so as not to hinder the rotation of the cam 32 when the contact 43*a* comes into contact with the rear end surface 33*a*.

Figure 6:
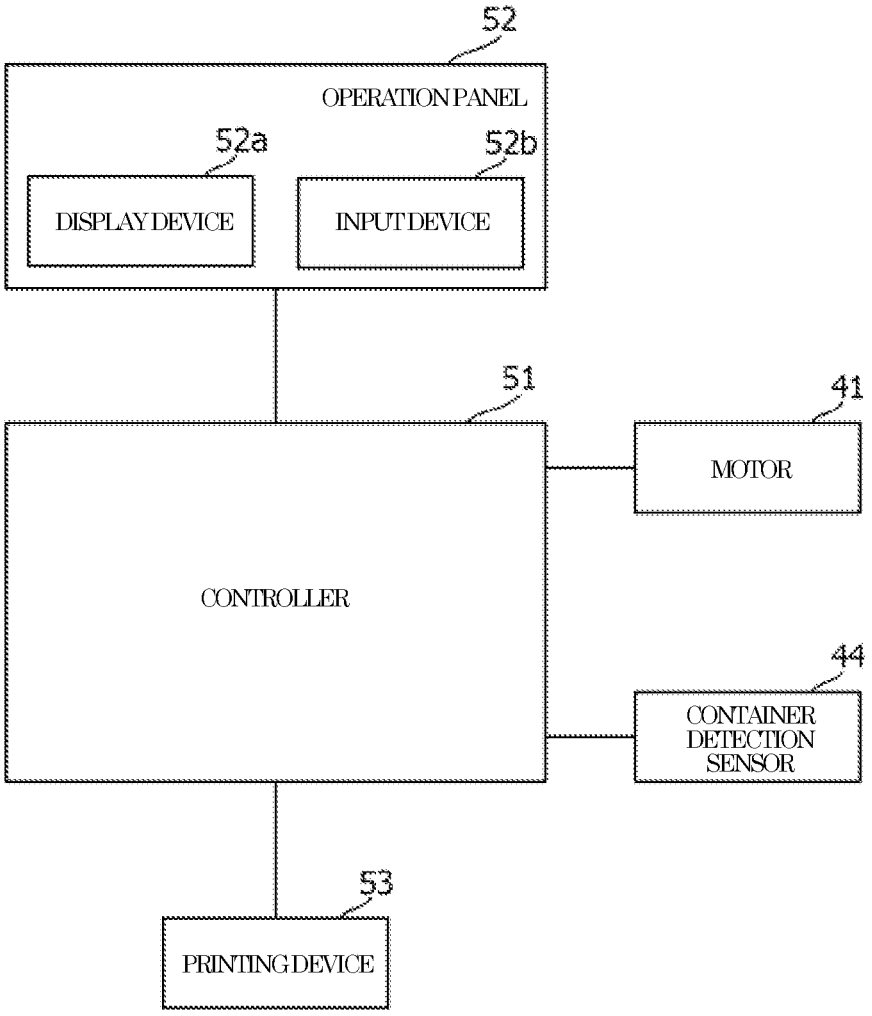
FIG. 6 is a block diagram showing an electrical configuration of the image forming apparatus according to the embodiment of the present disclosure.

FIG. 6 is a block diagram showing an electrical configuration of the image forming apparatus according to the embodiment of the present disclosure. As shown in FIG. 6, this image forming apparatus includes a controller 51, an operation panel 52, and a printing device 53 having the mechanical configuration shown in FIG. 1.

The controller 51 incorporates an application specific integrated circuit (ASIC), a computer, and the like. The controller 51 executes hardware processing by the ASIC and/or software processing by the computer to detect and control the state of the image forming apparatus.

The operation panel 52 is arranged on a housing surface of the image forming apparatus. The operation panel 52 includes a display device 52*a* for displaying various kinds of information to a user and an input device 52*b* for detecting a user operation. The display device 52*a* includes a liquid crystal display panel, an indicator, and the like. The input device 52*b* includes a touch panel, hard keys, and the like.

The controller 51 executes printing using the printing device 53 (such as the photoconductor drums 1*a* to 1*d*, the exposure devices 2*a* to 2*d*, and the developing devices 3*a* to 3*d*). Specifically, upon receipt of a request for a print job, the controller 51 executes printing of the print job designated by the request.

In addition, the controller 51 distinguishes, based on the sensor signal of the container detection sensor 44, between at least three states: a state where the toner container 21 is not attached; a state where the toner container 21 filled with toner of the first initial toner filling amount (here, the bundled container) is attached; and a state where the toner container 21 filled with toner of the second initial toner filling amount (here, the optional container) is attached.

Specifically, the controller 51 controls the motor 41 to rotate the toner conveying roller 22 (i.e., the cam 32), and distinguishes between at least three states described above based on the level of the sensor signal during the rotation period of the toner conveying roller 22. At this time, the toner conveying roller 22 (i.e., the aforementioned cam 32) is rotated at least once.

In the present embodiment, the controller 51 distinguishes between at least three states described above in accordance with a result of determination on whether it is a case where one of the two values of the aforementioned binary signal is continuously detected during the rotation period, a case where the other one of the two values is continuously detected during the rotation period, or a case where one and the other one of the two values are detected during the rotation period.

In addition, when the image forming apparatus is first started up by the user (that is, when the user starts using the image forming apparatus for the first time after unpacking) and when the toner container 21 is replaced, the controller 51 controls the motor 41 to rotate the toner conveying roller 22 as described above, and distinguishes between at least three states described above based on the level of the sensor signal during the rotation period of the toner conveying roller 22.

Further, when the controller 51 determines that the toner container 21 filled with toner of the first initial toner filling amount (here, the bundled container) is attached, the controller 51 sets a set value (here, 700) of the number of printable sheets corresponding to the first initial toner filling amount. In addition, when the controller 51 determines that the toner container 21 filled with toner of the second initial toner filling amount (here, the optional container) is attached, the controller 51 sets a set value (here, 1500) of the number of printable sheets corresponding to the second initial toner filling amount.

It is noted that the controller 51 performs the above-described processing independently for each of the toner containers 21 of the respective toner colors.

Next, an operation of the above-described image forming apparatus will be described.

(a) Operation at First Startup by User

Figure 7:
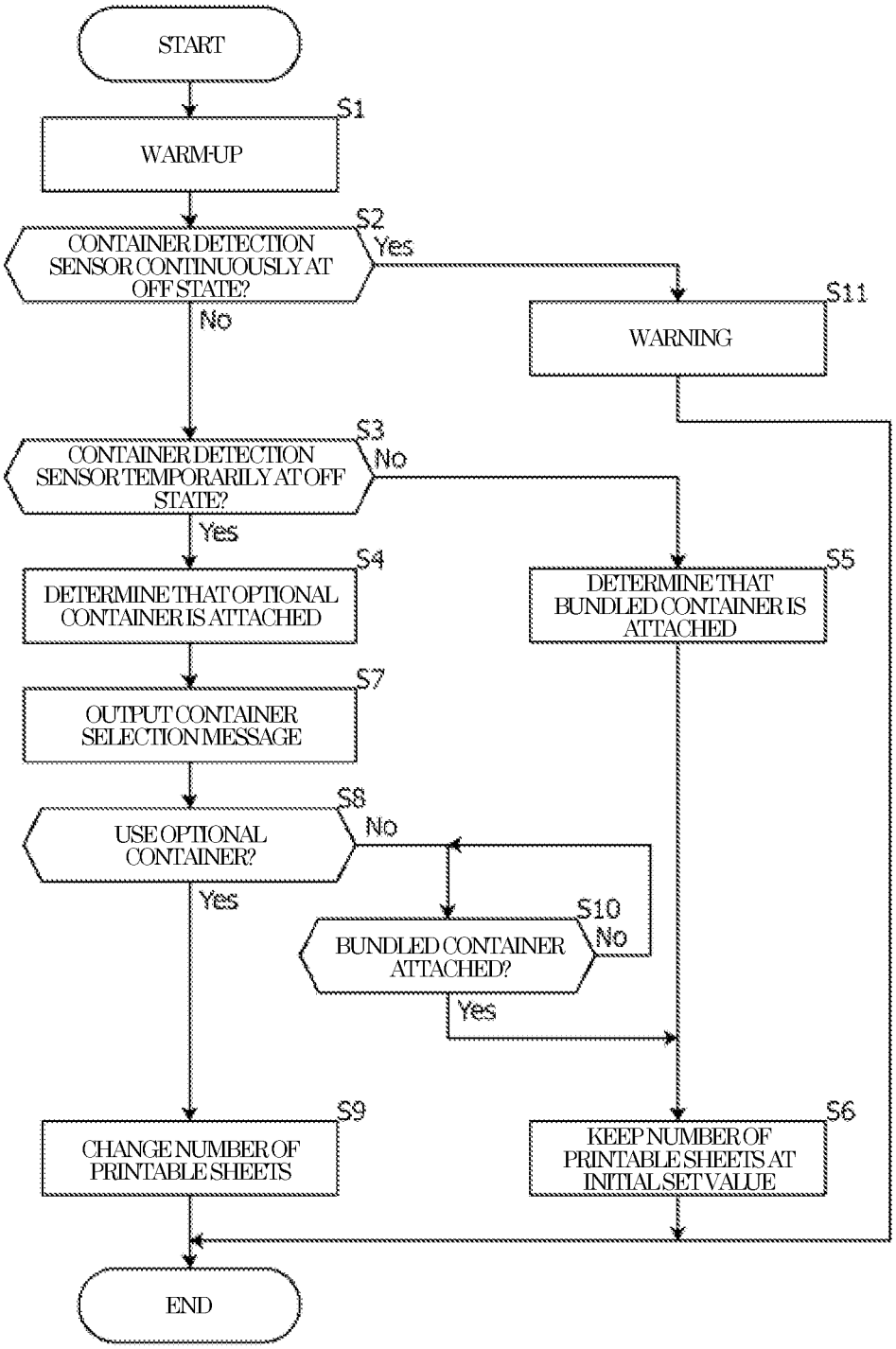
FIG. 7 is a flowchart illustrating an operation of the image forming apparatus shown in FIG. 1 (an operation at the first startup by the user).

FIG. 7 is a flowchart illustrating an operation of the image forming apparatus shown in FIG. 1 (an operation at the first startup by the user).

When a power switch (not shown) is switched to an ON state, the controller 51 determines whether or not the current startup is the first startup, and when it is determined that the current startup is the first startup, the controller 51 executes the following processing.

The controller 51 executes warm-up of the printing device 53 or the like (step 51). At that time, the controller 51 controls the motor 41 to rotate the toner conveying roller 22 of the toner container 21 by a predetermined angle in a predetermined rotation period, and continuously detects the level of the sensor signal of the container detection sensor 44 during the rotation period.

The controller 51 determines whether or not the sensor signal was continuously at a level indicating the OFF state during the rotation period (step S2).

When it is determined that the sensor signal was not continuously at the level indicating the OFF state during the rotation period, the controller 51 determines whether or not the sensor signal was temporarily at the level indicating the OFF state during the rotation period (that is, whether or not the sensor signal was at both the level indicating the ON state and the level indicating the OFF state) (step S3).

When it is determined that the sensor signal was temporarily at the level indicating the OFF state during the rotation period, the controller 51 determines that the currently attached toner container 21 is the optional container (step S4).

Specifically, when the currently attached toner container 21 is the optional container, the notch 33 is formed in the disk-shaped cam 32, and the level of the sensor signal is changed by the rotation of the cam 32 as shown in FIG. 5, for example. Specifically, the level of the sensor signal changes between a case where the notch 33 is at the contact position with the contact 43*a* and a case where a portion other than the notch 33 is at the contact position with the contact 43*a*. Therefore, when the sensor signal was temporarily at the level indicating the OFF state during the rotation period, it is determined that the currently attached toner container 21 is the optional container.

On the other hand, when it is determined that the sensor signal was not at all at the level indicating the OFF state during the rotation period, the controller 51 determines that the currently attached toner container 21 is the bundled container (step S5).

Specifically, when the currently attached toner container 21 is the bundled container, the notch 33 is not formed in the disk-shaped cam 32, and the level of the sensor signal does not change during the rotation period. Therefore, when the sensor signal was not at all at the level indicating the OFF state during the rotation period (that is, when the sensor signal was continuously at the level indicating the ON state during the rotation period), it is determined that the currently attached toner container 21 is the bundled container.

In this case, the controller 51 keeps the set value of the number of printable sheets at the initial set value (here, 700) at the time of shipment from the factory (step S6).

It is noted that, at the time of shipment from the factory, the bundled container, which can print a smaller number of sheets, is bundled with the image forming apparatus as the toner container 21, and the number of printable sheets of the bundled container is preset as the initial set value. Therefore, when the user does not attach the optional container instead of the bundled container but attaches the bundled container, the set value of the number of printable sheets is left at the initial set value at the time of shipment from the factory.

On the other hand, when it is determined that the currently attached toner container 21 is the optional container (step S4), the controller 51 outputs a container selection message to the user (step S7). It is noted that the controller 51 displays the container selection message on the display device 52*a* of the operation panel 52, causes the printing device 53 to print the container selection message, or transmits the container selection message to the user's host device. In addition, the container selection message indicates that the optional container is currently attached, a request prompting an answer as to which of the bundled container and the optional container is to be used, a procedure for replacing the toner container 21, and the like.

The controller 51 further displays on the display device 52*a* an operation screen for receiving a user operation indicating a user's response to the container selection message (selection of one of the bundled container and the optional container). Then, the controller 51 detects the user operation by the input device 52*b*, and identifies which of the bundled container and the optional container the user has selected.

Upon detection of the user operation by the input device 52*b*, the controller 51 determines whether or not the user has selected to use the optional container (step S8).

When it is determined that the user has selected to use the optional container, the controller 51 changes the set value of the number of printable sheets to a set value (here, 1500) corresponding to the optional container (step S9).

On the other hand, when it is determined that the user has selected to use the bundled container, the controller 51 displays a message to prompt replacement of the toner container 21 (replacement of the optional container with the bundled container) on the display device 52*a*, and waits until the bundled container is attached (step S10). When the bundled container is attached, the controller 51 keeps the set value of the number of printable sheets at the initial set value (here, 700) at the time of shipment from the factory (step S6).

It is noted that, in step S10, the controller 51 monitors the level of the sensor signal of the container detection sensor 44. When attachment of a toner container 21 is detected by a change in the level of the sensor signal after a toner container 21 (the optional container) is detached, the controller 51 controls the motor 41 to rotate the toner conveying roller 22 (i.e., the cam 32), and determines whether or not the bundled container has been attached based on the level of the sensor signal during the rotation period.

Thereafter, the controller 51 reduces the number of printable sheets by one every time one sheet is printed by the printing device 53, thereby managing the number of printable sheets (i.e., the remaining amount of toner).

On the other hand, when it is determined in step S2 that the sensor signal was continuously at the level indicating the OFF state during the aforementioned rotation period, the controller 51 determines that the toner container 21 is not attached and outputs a warning to prompt attachment of the toner container 21 (step S11). Thereafter, the controller 51 monitors the level of the sensor signal and, when it is detected that the toner container 21 has been attached based on a change in the level of the sensor signal, executes, for example, the processing from step S1 onward again.

(b) Operation at Toner Container Replacement

After the initial set value of the number of printable sheets corresponding to the type of the toner container 21 is set as described above, the controller 51 determines that a toner empty has occurred when the number of printable sheets (i.e., the remaining amount of toner) decreases to a predetermined threshold value. In this case, the controller 51 displays, on the display device 52*a*, a message indicating that a toner empty has occurred and prompting replacement of the toner container 21.

Then, the controller 51 monitors the level of the sensor signal, and controls the motor 41 to rotate the toner conveying roller 22 (i.e., the cam 32) when attachment of the toner container 21 is detected by a change in the level of the sensor signal after the toner container 21 is removed. Then, the controller 51 determines which of the optional container and the bundled container is attached based on the level of the sensor signal during the rotation period, and sets an initial set value (here, 1500 or 700) of the number of printable sheets corresponding to the type (the optional container or the bundled container) of the attached toner container 21.

Thereafter, the controller 51 reduces the number of printable sheets by one every time one sheet is printed by the printing device 53, thereby managing the number of printable sheets (i.e., the remaining amount of toner).

As described above, according to the above embodiment, when the toner container 21 is attached, the motor 41 generates a driving force for rotating the toner conveying roller 22 in the toner container 21. The container detection sensor 44 is arranged at a position where the container detection sensor 44 comes into contact with the outer periphery of the cam 32 connected to the toner conveying roller 22 when the toner container 21 is attached. The controller 51 distinguishes, based on the sensor signal of the container detection sensor 44, between at least three states: a state where the toner container 21 is not attached; a state where the toner container 21 filled with toner of the first initial toner filling amount is attached; and a state where the toner container 21 filled with toner of the second initial toner filling amount, which differs from the first initial toner filing amount, is attached. The outer peripheral shape of the cam 32 of the toner container 21 filled with toner of the first initial toner filling amount differs from the outer peripheral shape of the cam 32 of the toner container 21 filled with toner of the second initial toner filling amount. The container detection sensor 44 includes a contact 43*a* that can move in accordance with the contact with the outer periphery of the cam 32, and the contact 43*a* is arranged at a position where the contact 43*a* can come into contact with the outer periphery of the cam 32. The container detection sensor 44 outputs a sensor signal at a level corresponding to the position of the contact 43*a*. The controller 51 controls the motor 41 to rotate the toner conveying roller 22 and distinguishes between at least three states described above based on the level of the sensor signal during a rotation period of the toner conveying roller 22.

This allows one sensor (container detection sensor 44) to distinguish between at least three states: a state where the toner container 21 is not attached; a state where the toner container 21 filled with toner of the first initial toner filling amount is attached; and a state where the toner container 21 filled with toner of the second initial toner filling amount, which differs from the first initial toner filing amount, is attached. That is, at least three such states can be detected at a relatively low cost.

For example, in the image forming apparatus, at the time of shipment from the factory, the initial set value of the number of printable sheets is set to the number of printable sheets of the bundled container (here, 700). Therefore, when the optional container is attached by the user at the start of use of the image forming apparatus, and the initial set value of the number of printable sheets is not changed to the value corresponding to the optional container (here, 1500), the optional container falsely detects a toner empty and printing cannot be continued even though the remaining amount of toner is actually sufficient. In the present embodiment, even when the optional container is attached by the user at the start of the first use of the image forming apparatus, the initial set value of the number of printable sheets is changed to the value corresponding to the optional container. Therefore, the number of printable sheets is appropriately managed, and false detection of a toner empty is suppressed.

It is noted that various changes and modifications to the above embodiment are obvious to those skilled in the art. Such changes and modifications may be made without departing from the intent and scope of the subject matter without diminishing the intended advantages. That is, such changes and modifications are intended to be included in the scope of the claims.

For example, the image forming apparatus according to the above embodiment may be a monochrome image forming apparatus.

Further, the image forming apparatus according to the above embodiment may be capable of distinguishing between toner containers 21 of three or more initial toner filling amounts in accordance with the outer peripheral shapes of the cams 32. For example, different numbers of notches 33 may be provided in the cams 32 in accordance with the different initial toner filling amounts, and the toner containers 21 may be distinguished based on patterns of the level of the sensor signal corresponding to the numbers of notches 33.

The present disclosure can be applied to, for example, an image forming apparatus which a toner container can be attached to or detached from.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a motor configured to generate a driving force for rotating a toner conveying member in a toner container when the toner container is attached;

a container detection sensor arranged at a position where the container detection sensor comes into contact with an outer periphery of a cam connected to the toner conveying member when the toner container is attached; and a controller configured to distinguish between at least three states based on a sensor signal of the container detection sensor, the at least three states including: a state where the toner container is not attached; a state where the toner container filled with toner of a first initial toner filling amount is attached; and a state where the toner container filled with toner of a second initial toner filling amount different from the first initial toner filling amount is attached, wherein an outer peripheral shape of the cam of the toner container filled with the toner of the first initial toner filling amount differs from an outer peripheral shape of the cam of the toner container filled with the toner of the second initial toner filling amount, the container detection sensor includes a contact movable in accordance with contact with the outer periphery of the cam, the contact being arranged at a position where the contact is capable of coming into contact with the outer periphery of the cam, the container detection sensor outputs the sensor signal at a level corresponding to a position of the contact, the controller controls the motor to rotate the toner conveying member and distinguishes between the at least three states based on the level of the sensor signal during a rotation period of the toner conveying member, the container detection sensor includes a push switch, the push switch includes the contact, the container detection sensor outputs the sensor signal varying between two values according to the position of the contact, and the controller distinguishes between the at least three states in accordance with a result of determination on whether it is a case where one of the two values is continuously detected during the rotation period, a case where another one of the two values is continuously detected during the rotation period, or a case where the one and the other one of the two values are detected during the rotation period.

2. The image forming apparatus according to claim 1, wherein the controller controls the motor to rotate the toner conveying member at a first startup of the image forming apparatus and at replacement of the toner container by a user, and distinguishes between the at least three states based on the level of the sensor signal during the rotation period of the toner conveying member.

3. The image forming apparatus according to claim 1, wherein the toner container filled with the toner of the first initial toner filling amount is a bundled container that is bundled with the image forming apparatus, and the toner container filled with the toner of the second initial toner filling amount is an optional container that is not bundled with the image forming apparatus but sold separately from the image forming apparatus.

4. The image forming apparatus according to claim 1, wherein the controller sets a set value of a number of printable sheets corresponding to the first initial toner filling amount when it is determined that the toner container filled with the toner of the first initial toner filling amount is attached, and sets a set value of a number of printable sheets corresponding to the second initial toner filling amount when it is determined that the toner container filled with the toner of the second initial toner filling amount is attached.

* * * * *